US007414588B2

(12) United States Patent
Tateno

(10) Patent No.: US 7,414,588 B2
(45) Date of Patent: Aug. 19, 2008

(54) AUTOMOBILE ANTENNA

(75) Inventor: Kouichi Tateno, Tokyo (JP)

(73) Assignee: Clarion Co., Ltd., Tokyo (JP)

( * ) Notice: Subject to any disclaimer, the term of this patent is extended or adjusted under 35 U.S.C. 154(b) by 115 days.

(21) Appl. No.: 10/572,689

(22) PCT Filed: Sep. 22, 2004

(86) PCT No.: PCT/JP2004/013801

§ 371 (c)(1),
(2), (4) Date: Mar. 21, 2006

(87) PCT Pub. No.: WO2005/031915

PCT Pub. Date: Apr. 7, 2005

(65) Prior Publication Data

US 2007/0046551 A1 Mar. 1, 2007

(30) Foreign Application Priority Data

Sep. 26, 2003 (JP) ..... 2003-334950

(51) Int. Cl.
*H01Q 1/32* (2006.01)

(52) U.S. Cl. ..... 343/713; 343/872

(58) Field of Classification Search ..... 343/711, 343/713, 715, 872

See application file for complete search history.

(56) References Cited

U.S. PATENT DOCUMENTS 5,757,327 A * 5/1998 Yajima et al. ..... 343/713

FOREIGN PATENT DOCUMENTS

| | | |
|---|---|---|
| EP | 1 291 961 | 3/2003 |
| JP | 02101582 | 4/1990 |
| JP | 06028812 | 2/1994 |
| JP | 11274832 | 10/1999 |
| JP | 2000252725 | 9/2000 |
| JP | 2002076732 | 3/2002 |
| JP | 2002246818 | 8/2002 |
| WO | 02/065579 | 8/2002 |

* cited by examiner

*Primary Examiner*—Michael C Wimer
(74) *Attorney, Agent, or Firm*—Michael J. Striker

(57) ABSTRACT

An automobile antenna capable of preserving a good outward appearance of an antenna shape intact while possessing favorable waterproof and dustproof qualities is provided.

An antenna mounted on an outside sheet panel of an automobile and comprising a base member that supports electrical parts for reception and transmission, a cover member that receives the electrical parts for reception and transmission, and a pad member made of an elastic material, and wherein the pad member is fitted internally into the cover member while covering an underside and an outer peripheral portion of the base member.

5 Claims, 7 Drawing Sheets

AUTOMOBILE ANTENNA

TECHNICAL FIELD

The present invention relates to an automobile antenna.

BACKGROUND ART

Automobiles mount thereon various communications apparatuses such as radio, television, telephone, navigator, etc. to receive, transmit, or receive and transmit ground wave and satellite wave.

Generally, such automobile antenna for reception, transmission, or reception and transmission comprises an antenna base, on which an electrical equipment substrate and bases of antenna elements are arranged, an antenna cover that covers the antenna base, and a sealing member (antenna pad) facing a vehicle body side, that is, an outer plate panel of an automobile.

With conventional antennas of this kind, an antenna base is fitted inside an opening of an antenna base cover and an antenna base pad having a bottom wall is externally fitted and fixed to the antenna base cover.

With such construction, however, the antenna base pad is mounted to an external shape of the antenna base, so that an appearance shape being different from an external shape of an antenna body presents itself with the result that an entire antenna is marred in outward appearance.

That is, an antenna base pad is a part made of a rubber material (EPDM material, elastomer, etc.) to fit a subtle R-surface shape of an outer plate panel of a vehicle body to achieve waterproofing into an interior of an antenna from outside, but always has a larger shape than that of an antenna base since the antenna base pad is put on a bottom of the antenna base from outside to cover an outside of the antenna base. Further, when the antenna is mounted on the outer plate panel, it is clamped from a back side of the outer plate panel by means of nuts or the like. At this time, the antenna cover is collapsed and deformed to extend outward, so that an apparent size is increased more and more. Therefore, an extreme, unpleasant sensation is produced on a shape of the antenna base and an appearance shape of the antenna body, and degradation in appearance is not avoided.

Also, since an outside portion of the antenna base pad projects outside the antenna cover, it is liable to be influenced by a change in environmental condition such as the sunshine, temperature change, etc., so that aging and deterioration are liable to accelerate. In addition, since the outside portion of the antenna base pad projects outside the antenna cover, there is involved a problem that it is susceptible to mechanical damage.

Patent Document 1: JP-A-2000-252725

DISCLOSURE OF THE INVENTION

Problems that the Invention is to Solve

The invention has been thought of in order to dissolve the conventional problems and has its object to provide an automobile antenna capable of preserving a good outward appearance of an antenna cover shape intact while possessing favorable waterproof and dustproof qualities.

Means for Solving the Problems

In order to attain the object, the invention provides an automobile antenna mounted on an outside sheet panel of an automobile and comprising a base member that supports electrical parts for reception or transmission, a cover member that receives the electrical parts for reception or transmission, and a pad member made of an elastic material, and wherein the pad member is fitted internally into the cover member while covering an underside and an outer peripheral portion of the base member.

Effect of the Invention

With such construction, the pad member is not mounted and fixed to the cover member but the pad member is mounted and fixed so as to embrace a face plate portion and an outer periphery of the base member and fitted internally into the cover member in that state, so that the pad member is received in an outer profile of the cover member and the antenna can be maintained as a shape of the cover member intact in outward appearance.

Therefore, an entire antenna is free of unpleasant sensation in shape and can be made good in appearance and compact, and since an outside portion of the pad member does not project, aging and deterioration under the environmental condition are lessened and the antenna can be made hard to suffer from mechanical damage.

DESCRIPTION OF REFERENCE NUMERALS AND SIGNS

Figure 1:
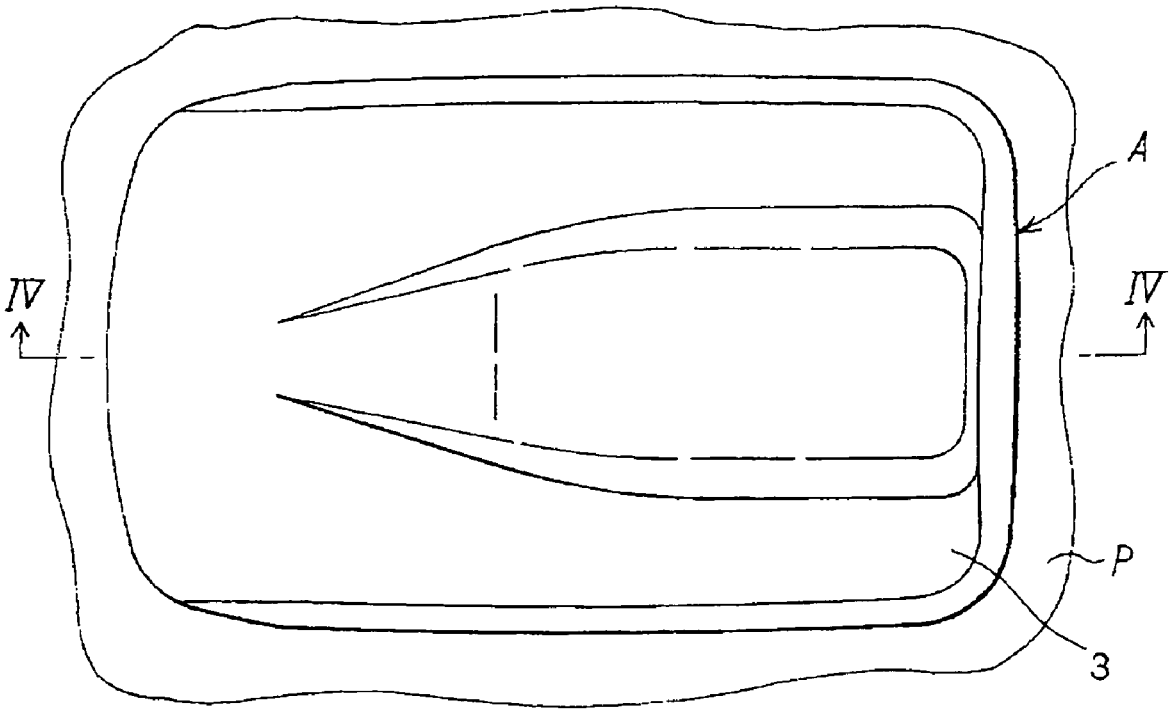
FIG. 1 is a plan view showing in the used state a first embodiment of an automobile antenna according to the invention.

1: base member
2: pad member
3: cover member
4: screw member
5: embrace cavity
11: through-hole
12: recess
14: tapered surface
15: flange
22: fitting portion
25: annular rib for fixation
220: annular projection
26: roofed boss

27, 28, 29: waterproof rib
30: outer peripheral wall
31: inner peripheral wall
32: female-threaded cylinder

BEST MODE FOR CARRYING OUT THE INVENTION

In a preferred embodiment of the invention, the base member comprises on an outer periphery thereof a tapered surface diverging downward and a flange projecting outward from a lower end of the tapered surface, the pad member comprises, in the vicinity of an outer peripheral edge thereof, a fitting portion for the cover member, an annular rib for fixation, which adjoins the fitting portion to contact with the tapered surface, and a diverging embrace cavity defined by the annular rib, and the tapered surface and the flange of the base member are interposingly fixed to the diverging embrace cavity.

With such construction, the base member and the pad member can be simply and surely united with each other, and since the annular rib for fixation contacts closely with the tapered surface of the cover member, it becomes possible to ensure a waterproof ability.

More preferably, the cover member comprises an outer peripheral wall and an inner peripheral wall arranged at a predetermined space therefrom, and the pad member is provided with an annular projection, which extends from a part of a fitting portion being fitted inside the outer peripheral wall and is press fitted between the outer peripheral wall and the inner peripheral wall.

With such construction, the pad member can be firmly fitted internally into and fixed to the cover member, and sure waterproofing can be achieved by strong contact between the fitting portion of the pad member and an inner surface of the outer peripheral wall of the cover member, and strong contact between the annular projection of the pad member and the inner peripheral wall of the cover member.

More preferably, the cover member comprises a waterproof rib on a lower end surface of the inner peripheral wall to bite into an upper surface of the pad member in the vicinity of the annular projection.

Thereby, since sealing can be achieved in one location in addition to strong contact between the fitting portion and an inner surface of the outer peripheral wall and strong contact between the annular projection and the inner peripheral wall, it is possible to further improve the waterproof ability.

More preferably, the base member comprises through-holes positioned in a plurality of locations to extend through a plate thickness, and recesses coaxial with the through-holes, the pad member comprises roofed bosses fitted into the recesses, screw members extend through the roofed bosses and the through-holes into the cover member to be threaded into female-threaded cylinders provided on the cover member whereby the pad member, the base member, and the cover member are clamped together.

Thereby, positioning at the time of assembly of the pad member, the base member, and the cover member is easy and it is possible to achieve sure unification without the need of external nuts.

While other embodiments and advantages of the invention will be made apparent in the following detailed description, the constitution shown in the embodiments is not limitative as far as fundamental features of the invention are provided.

It is apparent that those skilled in the art can make various modifications and corrections without departing from the thought or the scope of the invention.

First Embodiment

Embodiments of the invention will be described below with reference to the drawings.

Figure 2:
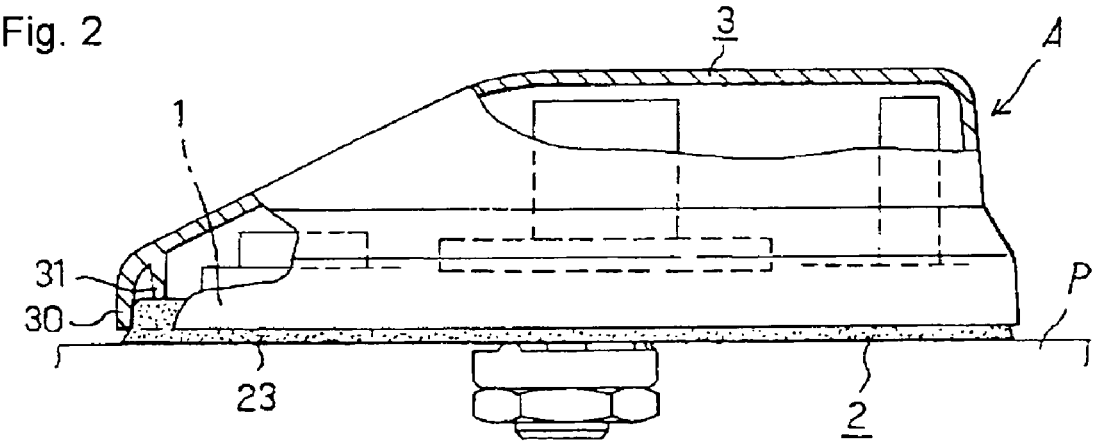
FIG. 2 is a fragmentary, side view showing the first embodiment.
Figure 3:
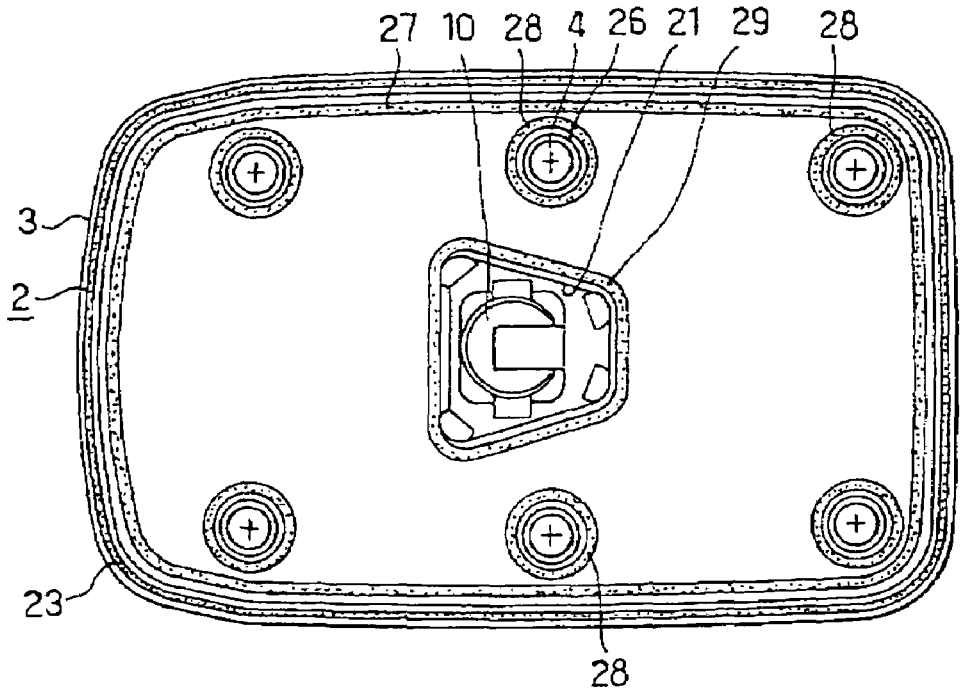
FIG. 3 is a bottom view showing the antenna according to the first embodiment.

FIGS. 1 to 7 show a first embodiment of an antenna for automobiles, according to the invention. FIGS. 1 and 2 show a whole of the embodiment and FIGS. 3 to 7 show details thereof.

In FIGS. 1 and 2, A denotes an antenna, according to the invention, being fixed to an outside sheet panel P of a vehicle body, such as roof, A pillar, trunk lid, or the like.

Figure 7:
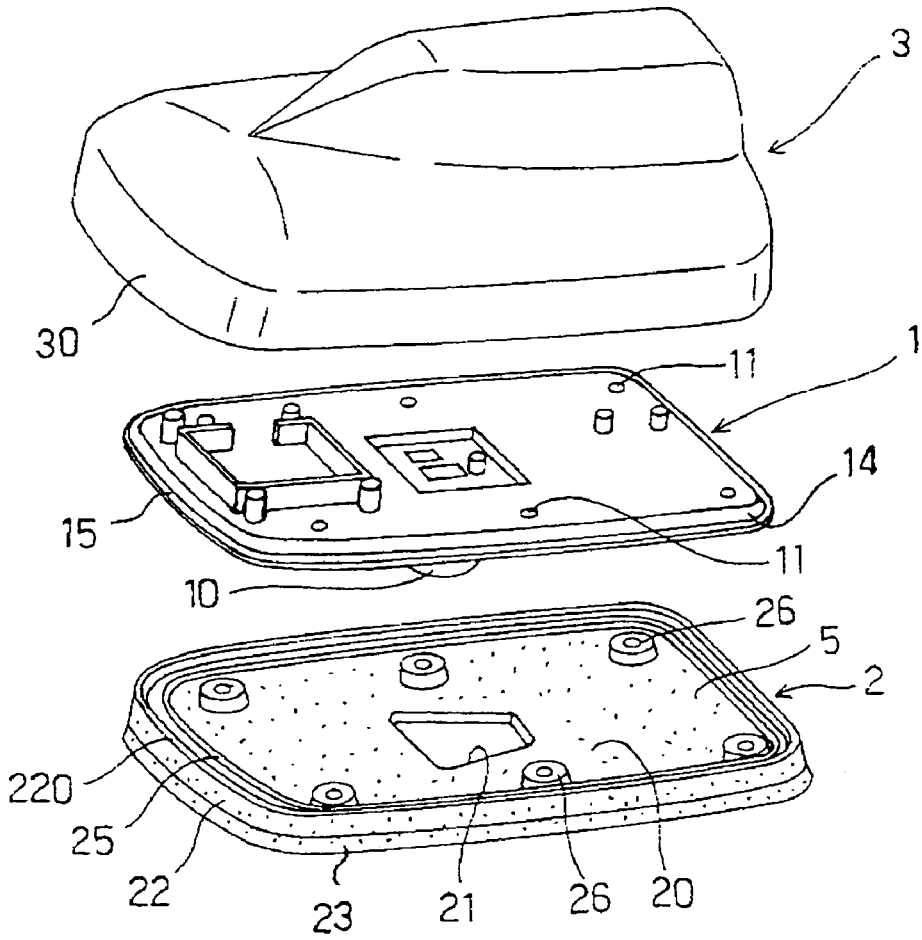
FIG. 7 is an exploded, perspective view showing the antenna according to the first embodiment.

The antenna A comprises, as shown in FIGS. 2 and 7, a base member 1 that supports an electrical equipment substrate including receiving or receiving/transmitting electrical parts, a base pad member 2 embracing a bottom and an outer periphery of the base member 1 to be made integral therewith, and a cover member 3 that fits onto the base pad member 2 to store the same in an outer profile of an opening thereof.

As shown in FIGS. 1 and 2, the cover member 3 is stationarily positioned in an appearance as formed such that a lower portion thereof is close to a surface of the outside sheet panel P, and the pad member 2 is put in a state of being not visually recognized from above as in FIG. 1 since it does not project outside from the cover member 3.

Figure 6:
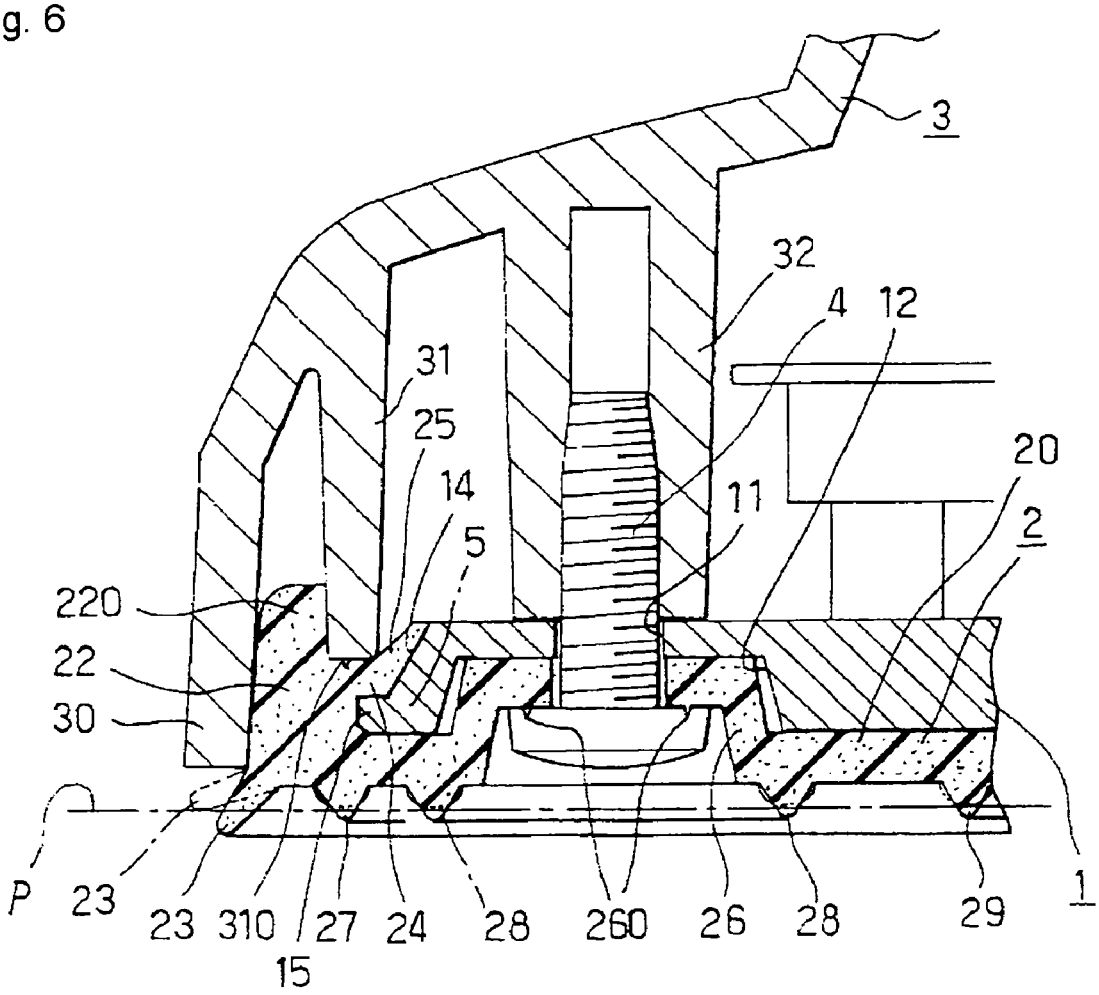
FIG. 6 is a partially, enlarged view of FIG. 5.

Describing a detailed construction of the antenna A, the base member 1 is made from a die-cast product such as aluminum alloy, includes a boss for supporting of the electrical equipment substrate on an upper surface side thereof and is provided integrally on an underside of a substantially central portion thereof with a male threaded shaft 10 to extend through a through-hole of the outside sheet panel P to be clampingly fixed by means of a nut or the like. Also, through-holes 11 are arranged on a portion of the base member close to an outer periphery thereof and spaced from one another to extend through a plate thickness, and circular-shaped recesses 12 are formed around lower surface sides of the through-holes as shown in FIG. 6.

Figure 4:
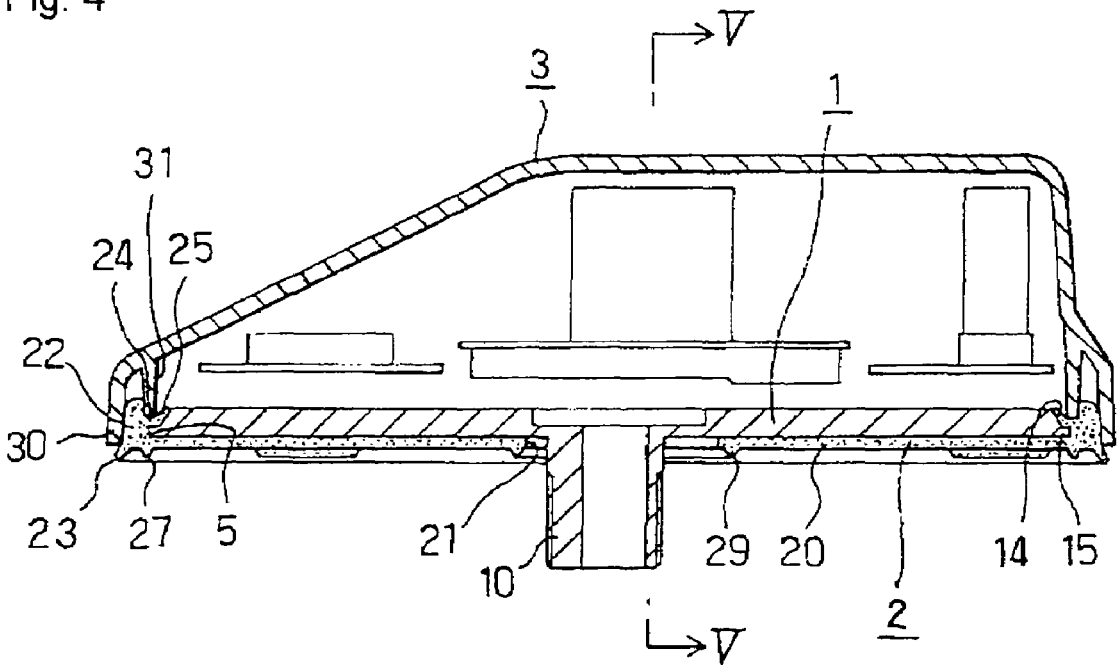
FIG. 4 is a cross sectional view taken along the line IV-IV in FIG. 1.

The base member 1 is similar to a shape of the profile of the opening of the cover member 3 but is formed to be considerably smaller than the cover member 3, and a side portion thereof defining an outer profile is formed as shown in FIGS. 4 and 7 with a tapered surface 14, which extends downward at a predetermined angle over a whole periphery thereof and from a lower end of which is formed a flange 15 projecting slightly outside.

The cover member 3 has a volume sufficient to embrace electrical parts for transmission & reception, mounted on the base member 1 and an outer peripheral wall 30 has a substantially larger diameter than the outer profile of the base member 1.

A lower portion of the outer peripheral wall 30 extends vertically or appropriately while according to the invention an inner peripheral wall 31 is formed in opposition to the outer peripheral wall 30 with a predetermined spacing therefrom. Also, female-threaded cylinders 32 are formed depending to be arranged at intervals corresponding to the through-holes 11 of the base member 1.

The base pad member 2 is shown in detail in FIGS. 4 to 7 and made of an elastic material typified by rubber such as silicone, FPDM, or the like. The base pad member 2 includes a face plate portion 20 capable of coming into close contact with a bottom surface of the base member 1, and a thick-walled fitting portion 22 is formed in the vicinity of an outer periphery of the face plate portion and has an outer surface, which should come into close contact with an inner surface of an outer peripheral wall of the cover member 3. The face plate portion 20 is formed with a window hole 21, from which the male threaded shaft 10 projects. Provided on an upper portion of the fitting portion 22 is an annular projection 220 being press fitted into a clearance between the outer peripheral wall 30 of the cover member 3 and the inner peripheral wall 31. The annular projection 220 is inclined suitably inward in a state before being assembled.

Also, as shown in FIG. 6, formed protrusively on an underside of the fitting portion 22 is a tongue-shaped skirt 23 inclined outward to be closely contacted by the outside sheet panel P. The skirt 23 is tapered and set in length so as not to project outward from a profile of the outer peripheral wall 30 of the cover member 3 as indicated by virtual lines in FIG. 6 even when being pushed against the outside sheet panel P.

A short, inner flange 24 closely contactable with a lower end surface of the inner peripheral wall 31 of the cover member 3 is provided contiguous to and inwardly of a root of the annular projection 220, and a small, triangular-shaped annular waterproof rib 310 is formed on the lower end surface of the inner peripheral wall 31 of the cover member 3 to be able to bite into the inner flange 24.

An inward and obliquely upward annular rib 25 for fixation is formed on the inner flange 24, and the annular rib 25 for fixation is tongue-shaped to have an angle corresponding to the tapered surface 14 of the base member 1 as shown in FIG. 6.

Also, an inner side of the fitting portion 22 and an underside of the inner flange 24 are dented to correspond to a shape of the flange 15 of the base member 1, so that a diverging embrace cavity 5 is defined by the inner side of the fitting portion 22, the underside of the inner flange 24, and an inner surface of the annular rib 25 for fixation.

The term "diverging" means that a space, a lower end of which is larger in cross sectional area than an upper end thereof, is defined since the annular rib 25 for fixation overhangs inward to be undercut in shape.

Bosses (referred below to as roofed bosses) 26 having a top wall able to fit in the recesses 12, respectively, are protrusively formed on the face plate portion 20 to be positioned corresponding to the respective recesses 12 of the base member 1, and a small waterproof rib 260 connecting with an underside of a head of the screw member to be threaded on the female-threaded cylinder 32 of the cover member 3 is formed on an underside of a head of the roofed boss 26 as shown in FIG. 6.

Also, an annular waterproof rib 27 having a triangular-shaped cross section is protrusively formed on an underside of the face plate portion 20 inwardly of the skirt 23 to have a lower projecting height than that of the skirt 23, and annular waterproof ribs 28, 29, respectively, are protrusively formed in a region corresponding to peripheries of the roofed bosses 26 and a region corresponding to a periphery of the window hole 21.

Describing an assembling process in the first embodiment, the pad member 2 is assembled to the base member 1 in a first stage from a separate state in FIG. 7 to form an assembly. In the process, it suffices to positionally register the respective roofed bosses 26 of the pad member 2 with the respective recesses 12 of the base member 1 to push the former into the latter, and an underside of the base member 1 is brought into close contact with a surface of the face plate portion 20 of the pad member 2 since the flange 15 on an outer periphery of the base member 1 is pushed into and widens the fixation annular rib 25 of the pad member 2. Simultaneously, the fixation annular rib 25 is brought into close contact with the tapered surface 14, so that the flange 15 on the outer periphery and the tapered surface 14 are interposingly fixed while being embraced by the diverging embrace cavity 5, which is defined by the inner surface of the fitting portion, the underside of the inner flange, and the inner side of the annular rib for fixation. Accordingly, the assembling work is easy and conveyance in an assembly line is also easy since the base member 1 and the pad member 2 are not separate from each other since then.

Figure 5:
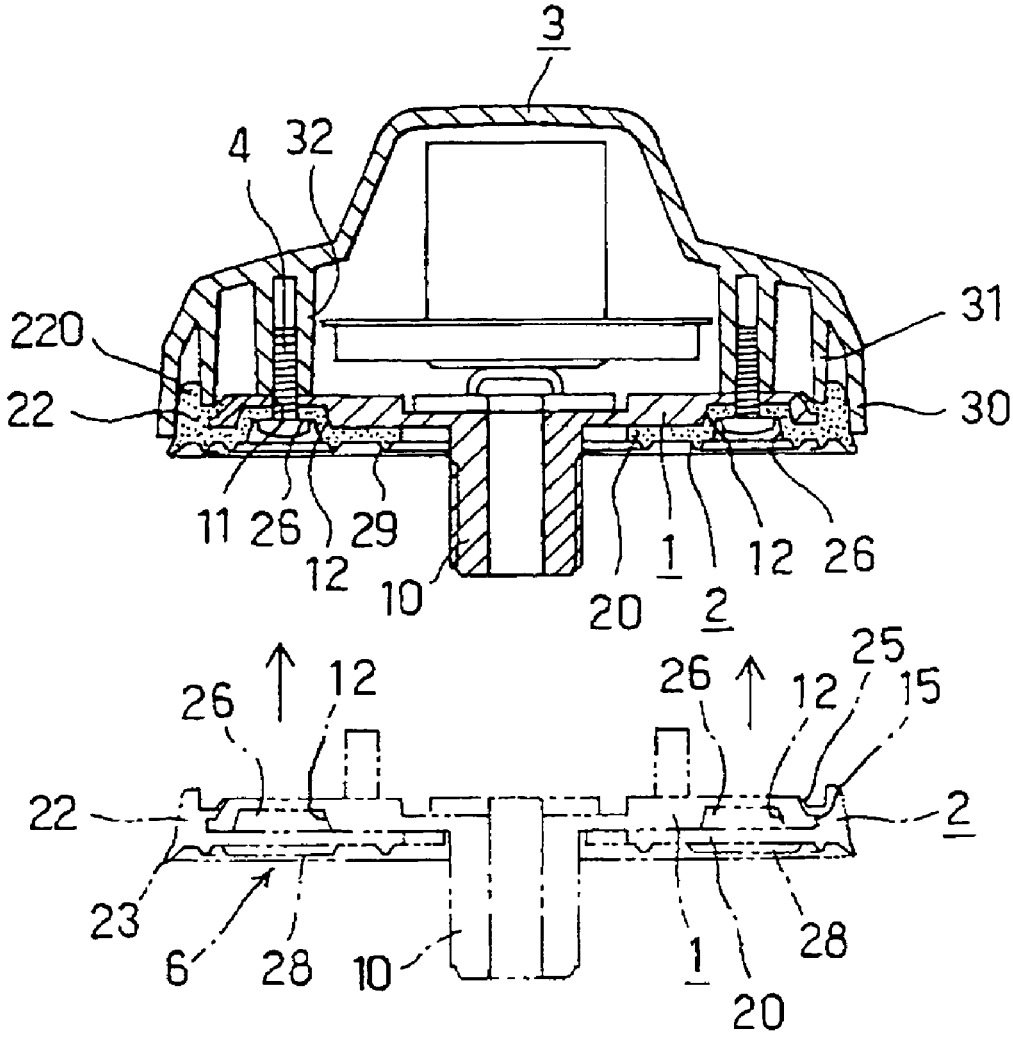
FIG. 5 is a cross sectional view taken along the line V-V in FIG. 4 and virtually showing a state before assembly.

An assembly 6 thus assembled is put in a state indicated by virtual lines in FIG. 5. Subsequently, the cover member 3 is fitted onto the assembly 6, at this time it suffices to perform positioning while confirming that respective centers of the recesses 12 of the base member 1 and the roofed bosses 26 of the pad member 2 in a united state are disposed on the same axes of the female-threaded cylinders 32 of the cover member 3, and thus by means of a fitting operation, the annular projection 220, which is liable to fall a little inwardly of the pad member 2, is deformed to be press fitted into the clearance between the outer peripheral wall 30 of the cover member 3 and the inner peripheral wall 31 while an outer surface of the fitting portion 22 of the pad member 2 is a little deformed and comes into close contact with an inner surface of the outer peripheral wall.

Here, when screw members 4 are inserted through the roofed bosses 26 of the pad member 2 and threaded into the female-threaded cylinders 32 depending from an inner top of the cover member 3, the cover member 3, the base member 1, and the pad member 2 are clamped together. Unification in a vertical direction is achieved by that fastening in a plurality of locations, which results from clamping together, and the annular projection 220 of the pad member 2 is press fitted between the outer peripheral wall 30 of the cover member 3 and the inner peripheral wall 31 to prevent deviation in a horizontal direction, so that an exact unification is realized.

Thus, an antenna as a single body indicated by solid lines in FIG. 5 is finished, so that mounting on an automobile is completed when the male threaded shaft 10 projecting from the pad member 2 is inserted into a fixation hole of the outside sheet panel P and a nut is threaded onto the male threaded shaft to be fastened thereto.

In the mounted state, as indicated by virtual lines in FIG. 6, the skirt 23 of the pad member 2 pressingly contacts with the outside sheet panel P to be inclined outward and the respective annular waterproof ribs 27, 28, 29 are depressed to pressingly contact with the outside sheet panel P. However, since a length of the skirt 23 of the pad member 2 is circumscribed in the profile of an outer surface of the outer peripheral wall 30 of the cover member 3, the pad member 2 is covered by the cover member 3. Therefore, an external shape of the antenna remains as an external shape of the cover member 3 up to the skirt. Accordingly, a very good appearance is provided and a compact and neat impression is created.

When the cover member 3 is mounted as described above, the annular projection 220 of the pad member 2 is press fitted between the outer peripheral wall 30 of the cover member 3 and the inner peripheral wall 31 while being deformed, and in particular, the annular projection 220 pressingly contacts with an outer surface of the inner peripheral wall 31. Also, the outer surface of the fitting portion 22 is a little deformed to pressingly contact with the inner surface of the outer peripheral wall. Accordingly, it is possible to surely prevent invasion of water and dust from outside the cover member 3. Further, an annular waterproof rib 330 is provided on the lower end surface of the inner peripheral wall of the cover member 3 to bite into an upper surface of the inner flange 24 on the pad member 2 when being fastened by the screw members 4. Therefore, it is possible to achieve a further sure and complete waterproofing.

Also, primary waterproofing and dustproofing can be achieved for the outside sheet panel P and the pad member 2 since the skirt 23 on the outer periphery of the pad member 2 pressingly contacts with the outside sheet panel P. Further, the annular waterproof rib 27 is provided all around and inside the skirt 23 of the pad member 2 and the waterproof ribs 28, 29, respectively, are provided on the circumference close to the roofed bosses 26 and around the window hole 21, from which the male threaded shaft 10 of the base member 1 projects, so that it is possible to surely achieve secondary waterproofing.

Second Embodiment

FIGS. 8 to 12 show a second embodiment of the invention.

Figure 8:
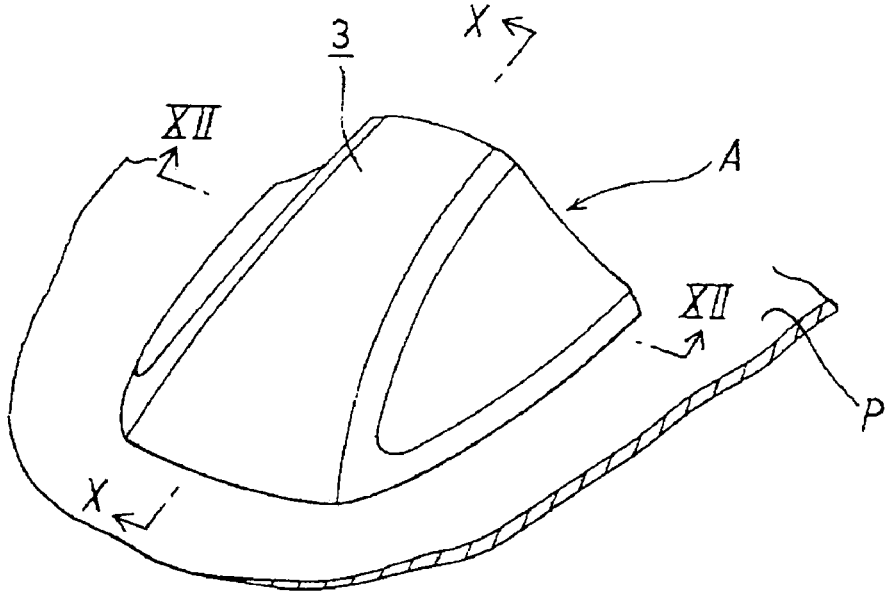
FIG. 8 is a perspective view showing a second embodiment of an automobile antenna according to the invention in use.

Also, in this embodiment, an antenna A comprises a base member 1 that supports an electrical equipment substrate including receiving or receiving/transmitting electrical parts, a pad member 2 embracing the base member 1 to be made integral therewith, and a cover member 3 that fits onto the pad member 2 to store the same in an outer profile of an opening thereof, the cover member 3 is stationarily positioned, as shown in FIG. 8, in an appearance as formed such that a lower portion thereof is close to a surface of the outside sheet panel P, and the pad member 2 is put in a state of being not visually recognized from above since it does not project outside from the cover member 3.

In the embodiment, the cover member 3 comprises an inner body 3*a* and an outer body 3*b* mounted thereon, and the pad member 2 has a feature in that a major portion thereof except a skirt 23 is fitted into the outer body 3*b* and the base member 1 is embraced by and mounted in the pad member 2.

Figure 10:
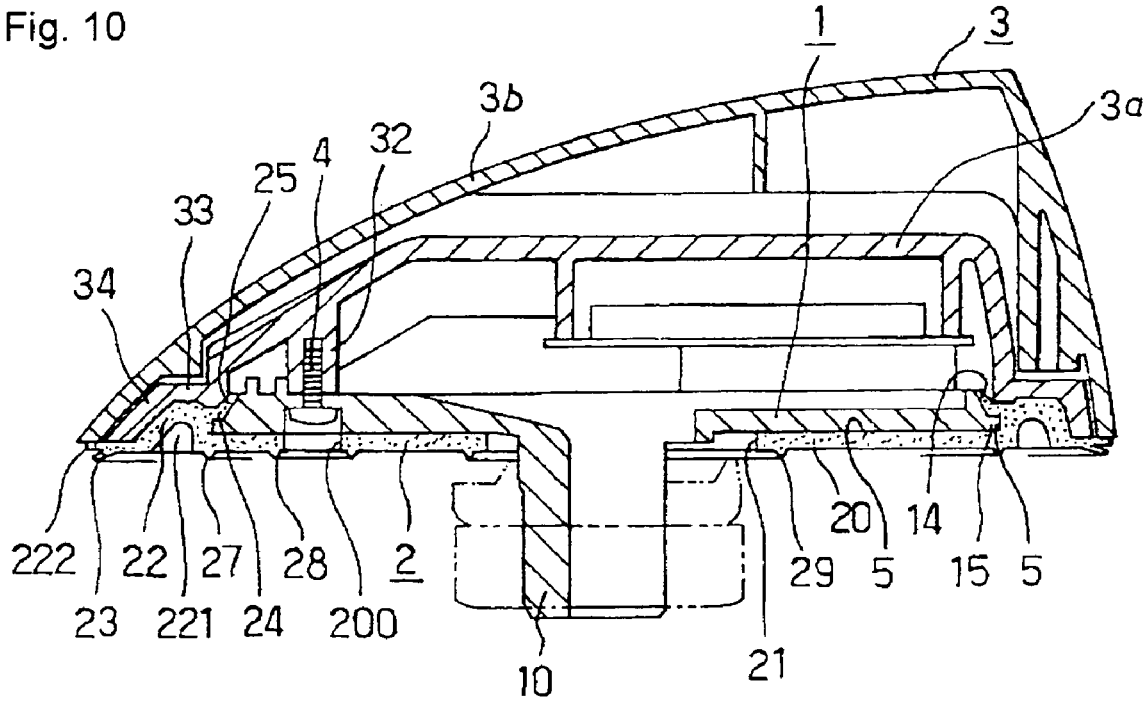
FIG. 10 is a cross sectional view taken along the line X-X in FIG. 8.
Figure 11:
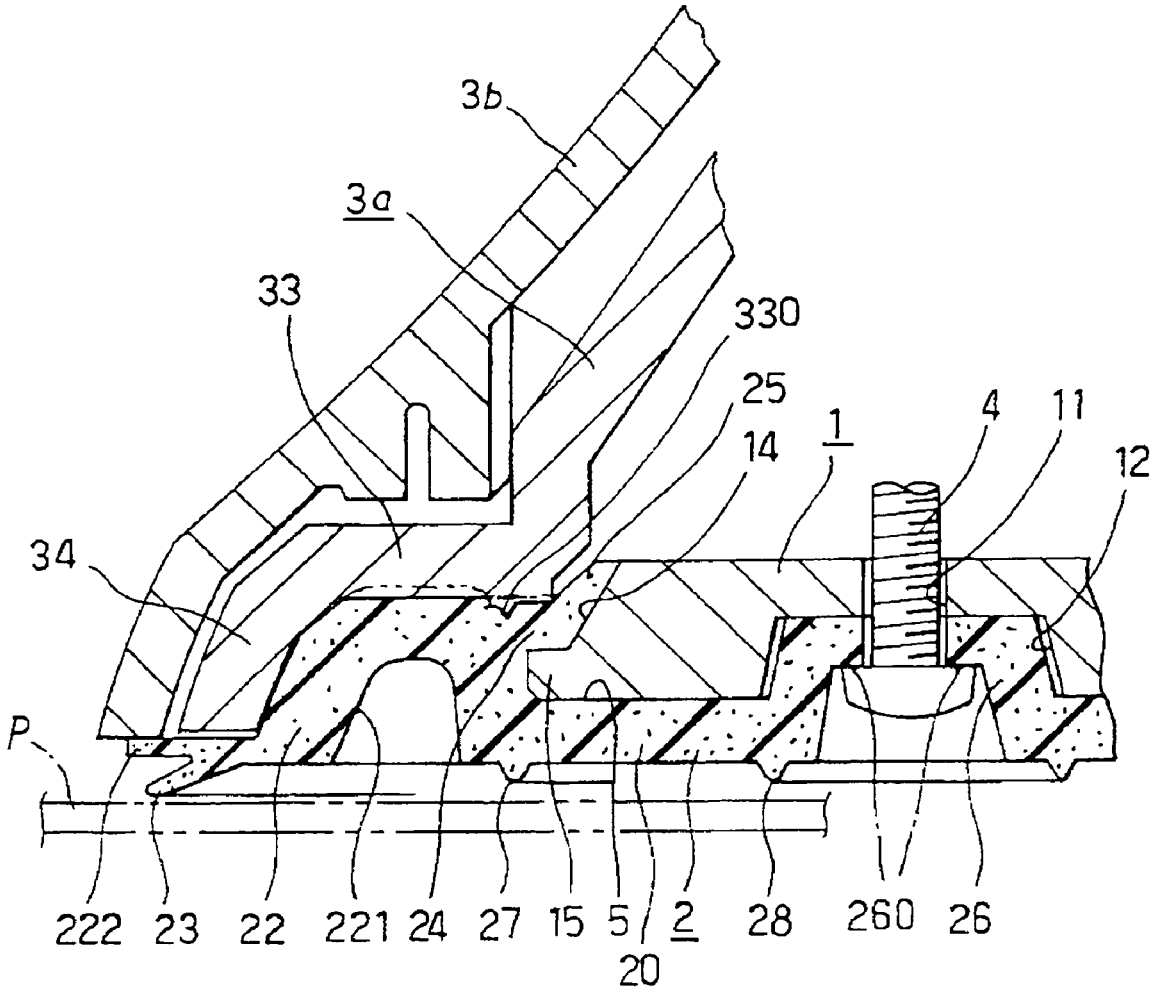
FIG. 11 is a partially, enlarged view of FIG. 10.
Figure 12:
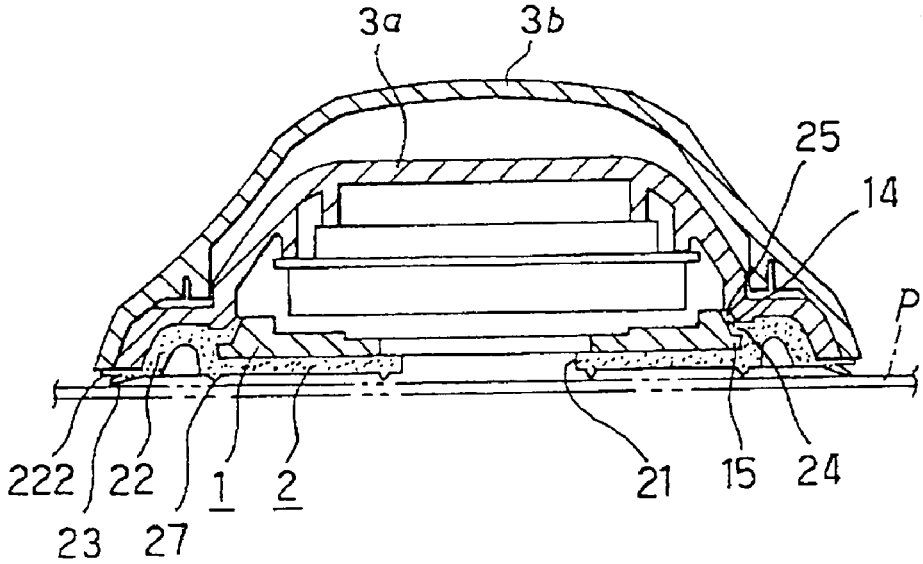
FIG. 12 is a cross sectional view taken along the line XII-XII in FIG. 8.

A curved opened wall 34 is provided in a lower region of the inner body 3*a* with a horizontal wall 33 therebetween as shown in FIGS. 10 and 11. Provided in a region corresponding to a root of the horizontal wall 33 is an annular waterproof rib 330 capable of biting into a boundary region of a fitting portion and an inner flange of the pad member 2 as shown in FIG. 11.

Also, a female-threaded cylinders 32 is formed on the inner body 3*a* to be positioned corresponding to through-holes, described later, of the base member 1 as shown in FIG. 10.

Through-holes 11 extending through a plate thickness and recesses 12 are arranged in a plurality of locations on the base member 1 as shown in FIG. 11, the base member comprising on an outer peripheral region thereof a tapered surface 14 spreading downward and a flange 15 projecting outside from a lower end of the tapered surface in the same manner as in the first embodiment.

In FIG. 10, holes 200 aligned with the through-holes 11 and the recesses 12 are formed on that face plate portion 20 of the pad member 2, which contacts closely with an underside of the base member 1. In place of such holes, the same construction as that in the first embodiment will do, that is, roofed bosses 26 substantially fitting into the recesses 12 may be protrusively formed in positions corresponding to the recesses 12 of the base member 1 as shown in FIG. 11.

Figure 9:
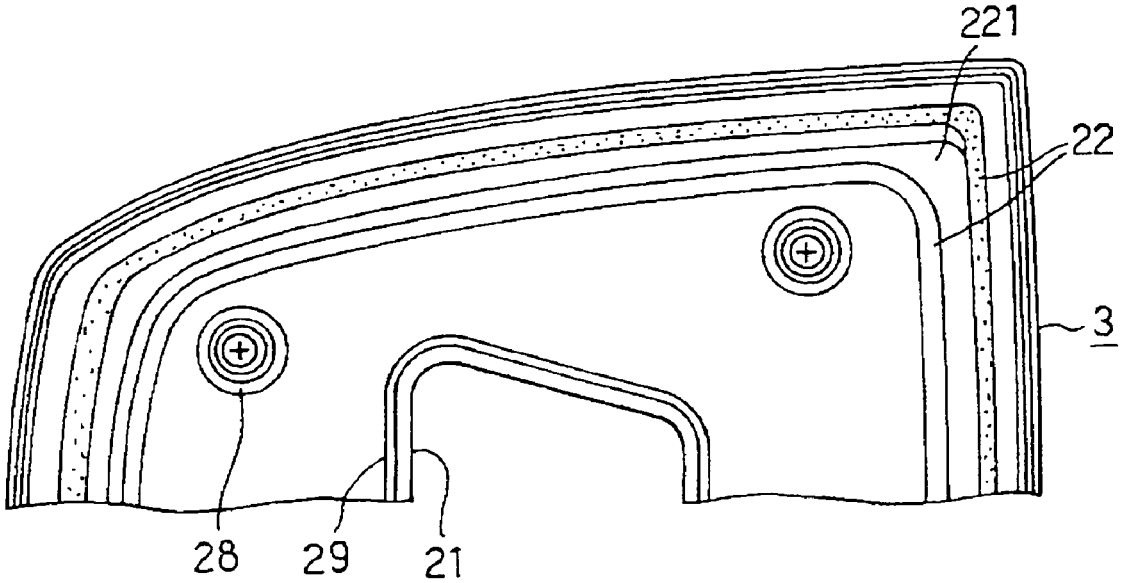
FIG. 9 is a bottom view showing a half of the second embodiment.

As shown in FIGS. 9 to 11, the pad member 2 comprises a fitting portion 22, which includes an annular groove 221 opened to an underside thereof and has a substantially U-shaped cross section on an outer edge portion of the face plate portion 20, and an outer profile of the fitting portion 22 is shaped to correspond to an annular recess defined by the horizontal wall 33 and the opened wall 34.

An annular rib 25 for fixation directed obliquely upward is formed inside the fitting portion 22 with a short inner flange 24 therebetween.

Also, as shown in FIGS. 10 and 11, an outer flange 222 serving for a stopper and extending horizontally is formed at a lower end of an outer periphery of the fitting portion 22, and a skirt 23 is provided contiguous to a base end region of the outer flange. Also, an annular waterproof rib 27 is protrusively formed in a position inwardly of the fitting portion 22 on the face plate portion 20 of the pad member 2 to have a lower projecting height than that of the skirt 23.

Annular waterproof ribs 28, 29, respectively, are also protrusively formed in a region corresponding to peripheries of the holes 200 or the roofed bosses 26 and a region corresponding to a periphery of the window hole 21.

Since the remaining construction is the same as that in the first embodiment, the same parts as those in the latter are denoted by the same reference numerals and the explanation for the latter is referred to.

Describing an assembling process in the second embodiment, the pad member 2 is first assembled to the base member 1 to form an assembly. In the operation, it suffices to positionally register the respective holes 200 or the respective roofed bosses 26 of the pad member 2 with the respective recesses 12 of the base member 1 to push the former into the latter, and when the flange 15 on an outer periphery of the base member 1 is pushed into the fixation annular rib 25 of the pad member 2 to widen the same, an underside of the base member 1 is brought into close contact with the face plate portion 20 of the pad member 2, the fixation annular rib 25 is brought into close contact with the tapered surface 14, and the flange 15 and the tapered surface 14 are interposingly fixed by the embrace cavity 5. Accordingly, assembling is easy.

Subsequently, the inner body 3*a* of the cover member 3 is fitted onto the assembly thus assembled. Since positioning is performed while confirming that centers of the recesses 12 of the base member 1 in an assembled state are disposed on the same axes as centers of the female-threaded cylinders 32 of the inner body 3*a*, push is made until the outer flange 222 abuts against a lower end surface of the opened wall 34.

Since the fitting portion 22 of the pad member 2 has the annular groove 221 in cross section, it is press fitted into the annular recess while being elastically deformed in the reduced state, so that an outer surface of the fitting portion 22 is a little deformed to come into close contact with an inner surface of the opened wall. Simultaneously, the fitting portion 22 and an upper surface of the inner flange 24 are elastically deformed to pressingly contact with an underside of the horizontal wall 33 and the annular waterproof rib 330 bites thereinto.

Hereupon, it suffices that screw members 4 be inserted through the holes 200 or the roofed bosses 26 of the pad member 2 and threaded into the female-threaded cylinders 32, whereby the cover member 3 and the base member 1, or the pad member 2 are clamped together to achieve unification.

In addition, the outer body 3*b* may cover the inner body 3*a* beforehand, or may cover the inner body after the base member and base pad member assembly is assembled to the inner body 3*a*.

Since the skirt 23 on the pad member 2 is sized to remain inside a wall of the outer body 3*b* and the pad member 2 is covered by the cover member 3, an external shape of the antenna remains as an external shape of the cover member 3 up to the skirt. Accordingly, a very good appearance is provided and a compact and neat impression can be created.

When the cover member 3 is to be mounted as described above, the fitting portion 22 of the pad member 2 is press fitted into the cover member 3 while being deformed, an upper region thereof pressingly contacts with the underside of the horizontal wall and the outer surface of the fitting portion 22 is a little deformed to pressingly contact with the inner surface of the opened wall. Accordingly, it is possible to surely prevent invasion of water and dust from outside the cover member 3. Further, the annular waterproof rib 330 is provided on the end surface of the horizontal wall of the cover member 3 to bite into an upper surface of the pad member 2. Therefore, it is possible to achieve a further sure and complete waterproofing.

Also, primary waterproofing and dustproofing can be achieved for the outside sheet panel P and the pad member 2 since the skirt 23 on the outer periphery of the pad member 2 pressingly contacts with the outside sheet panel P. Further, the waterproof rib 27 is provided all around and inside the skirt 23 of the pad member 2 and the waterproof ribs 28, 29, respectively, are also provided on the circumference close to the respective holes 200 or the roofed bosses 26 for clamping and around the window hole 21, from which the male threaded shaft 10 of the base member 1 projects, so that it is possible to surely achieve secondary waterproofing.

In addition, while according to the second embodiment the cover member 3 comprises the inner body 3*a* and the outer body 3*b*, it may comprise a single body in the same manner as in the first embodiment.

INDUSTRIAL APPLICABILITY

The invention is applied to various antennas mounted on vehicles, of which are demanded a neat configuration.

The invention claimed is:

1. An automobile antenna mounted on an outside sheet panel (P) of an automobile and comprising a base member (1) that supports electrical parts for reception or transmission, a cover member (3) that receives the electrical parts for reception or transmission, and a pad member (2) made of an elastic material, and wherein the pad member (2) is fitted internally into the cover member (3) while covering an underside and an outer peripheral portion of the base member (1), wherein the base member (1) comprises on an outer periphery thereof a tapered surface (14) diverging downward and a flange (15) projecting outward from a lower end of the tapered surface, the pad member (2) comprises, in the vicinity of an outer peripheral edge thereof, a fitting portion (22) for the cover member (3), an annular rib (25) for fixation, which adjoins the fitting portion (22) to contact with the tapered surface (14), and a diverging embrace cavity (5) defined by the annular rib, and the tapered surface (14) and the flange (15) of the base member (1) are interposingly fixed to the diverging embrace cavity (5).

2. The automobile antenna according to claim 1, wherein the cover member (3) comprises an outer peripheral wall (30) and an inner peripheral wall (31) arranged at a predetermined space therefrom, and the pad member (2) is provided with an annular projection (220), which extends from a part of a fitting portion (22) being fitted inside the outer peripheral wail (30) and is press fitted between the outer peripheral wall (30) and the inner peripheral wall (31).

3. The automobile antenna according to claim 2, wherein the cover member (3) comprises a waterproof rib (310) on a lower end surface of the inner peripheral wall (31) to bite into an upper surface of the pad member in the vicinity of the annular projection (220).

4. An automobile antenna mounted on an outside sheet panel (P) of an automobile and comprimising a base member (1) that supports electrical parts for reception or transmission, a cover member (3) that receives the electrical parts for reception or transmission, and a pad member (2) made of an elastic material, and wherein the pad member (2) is fitted internally into the cover member (3) while covering an underside and an outer peripheral portion of the base member (1), wherein the base member (1) comprises through-holes (11) positioned in a plurality of locations to extend through a plate thickness, and recesses (12) coaxial with the through-holes, the pad member (2) comprises roofed bosses (26) fitted into the recesses (12), screw members (4) extend through the roofed bosses (26) and the through-holes (11) into the cover member to be threaded into female-threaded cylinders (32) provided on the cover member (3) whereby the pad member (2), the base member (1), and the cover member (3) are clamped together.

5. The automobile antenna according to claim 1, wherein the pad member (2) comprises on an underside thereof waterproof ribs (27), (28), (29).

* * * * *